United States Patent [19]

Tezuka et al.

[11] 4,029,555

[45] June 14, 1977

[54] HIGH-SPEED CONTINUOUS PLATING METHOD AND APPARATUS THEREFOR

[75] Inventors: Junichi Tezuka, Isehara; Takatoshi Ando, Kamakura, both of Japan

[73] Assignee: Electroplating Engineers of Japan, Limited, Tokyo, Japan

[22] Filed: May 7, 1976

[21] Appl. No.: 684,291

[30] Foreign Application Priority Data

May 23, 1975 Japan ..... 50-61089

[52] U.S. Cl. ..... 204/15; 204/28; 204/206

[51] Int. Cl.[2] ..... C25D 5/02; C25D 5/04; C25D 5/08; C25D 17/00

[58] Field of Search ..... 204/15, 28, 206–211

[56] References Cited

UNITED STATES PATENTS

| | | | |
|---|---|---|---|
| 3,137,645 | 6/1964 | Vaughan et al. | 204/206 |
| 3,162,589 | 12/1964 | Pensak | 204/15 X |

*Primary Examiner*—G. L. Kaplan
*Attorney, Agent, or Firm*—Woodhams, Blanchard and Flynn

[57] ABSTRACT

A high-speed continuous plating method and apparatus wherein a plating solution is sprayed from an anode and spray nozzle against a plating solution spraying opening formed in an object feeding guide tunnel of the shape corresponding to the cross-sectional shape of objects to be plated while the objects are being continuously passed through the guide tunnel, thus making it possible to plate at high speed only the desired portions of any objects to be plated even if the shape of such objects is very complicated.

4 Claims, 5 Drawing Figures

HIGH-SPEED CONTINUOUS PLATING METHOD AND APPARATUS THEREFOR

This invention relates to a high-speed continuous plating method and apparatus therefor capable of continuously plating at high speed only the required portions of objects to be plated having a complicated special shape, such as, connectors for various electronic apparatus and devices or the like which are partially or intermittently connected with each other or irregular continuous strip-like objects.

The connectors conventionally used with electronic apparatus and devices are made from copper or its alloys and in applications where a high degree of reliability is required the connectors must be plated since they must possess such properties as corrosion resistance, wear resistance, and easy solderability in addition to good conductivity. While these connectors are mainly plated with gold, the connectors are also plated with other metals including rhodium, silver and various alloys.

In the past, the following plating methods have been proposed for plating objects having complicated shapes, such as, connectors, etc. However, none of these conventional methods has been satisfactory.

Firstly, in the case of one method in which a plating barrel is used to plate the entire surface of objects to be plated, it is impossible to accomplish high current density, high-speed plating of the objects and it is also impossible to plate only the desired portions of the objects or continuously plate the objects. For instance, this method is not capable of accomplishing an economically inexpensive plating by which only the required side, e.g., the contact portions of the connectors are plated and those portions requiring no plating are not plated.

With another conventional method of the type employing a plating rack in combination with a plating solution level control system, objects to be plated are not entirely plated, but only those portions which are immersed in the plating solution are plated, thus making it possible to accomplish to some extent the desired selective plating of the objects as well as continuous plating of the objects. However, this method is also disadvantageous in that the immersion of objects in a plating solution requires considerably troublesome labor and it is impossible to accomplish the desired high-speed plating.

With still another plating method, anticorrosive elastic material is used to completely mask those portions of objects which need not to be plated during a plating process. While this method is capable of accomplishing the desired high-speed plating by means of a plating solution spray system or the like and also capable of selectively plating only the desired portions of objects, it is still difficult to continuously apply plating on the objects. Moreover, this method is not satisfactory since it has other important disadvantages, namely, it is necessary to tightly mask all the portions of the objects excepting the selected portions for plating and particularly masking of continuous objects having a complicated shape requires considerable labor and their workability is very poor with the resulting increase in the overall cost. Other masking means employing tapes, paints, etc., have similar disadvantages.

In view of these circumstances, it is an object of this invention to provide a novel method and apparatus therefor which overcome all of the drawbacks of the above-mentioned conventional methods and are capable of continuously plating at high speed only the desired portions of objects having a special shape, such as, connectors having a complicated shape and connected with each other.

In accordance with this invention, objects to be plated such as irregularly shaped strip-like objects or partially or intermittently interconnected objects such as connectors are continuously fed into a plating box to plate only the desired portions of the objects to be plated and the plating of the objects is accomplished continuously at high speed with high current density by spraying a plating solution from a nozzle which is the anode while the objects to be plated are being fed through the plating box.

The masking guide means provided in the plating box is formed with an object feeding guide tunnel having a shape corresponding to the cross-sectional shape of the objects to be plated and leaving a suitable clearance between the outer surface of the objects and the inner wall of the tunnel during the feeding of the objects, and a plating solution is sprayed from a spray nozzle which is the anode against a plating solution spraying opening of the desired dimension which is opened to communicate with the guide tunnel while the objects are being fed through the guide tunnel to thereby plate only the desired portions of the objects.

The above and related objects and features of the invention will be apparent from a reading of the following description of the disclosure found in the accompanying drawings and the novelty thereof pointed out in the appended claims. In the drawings:

Figure 1:
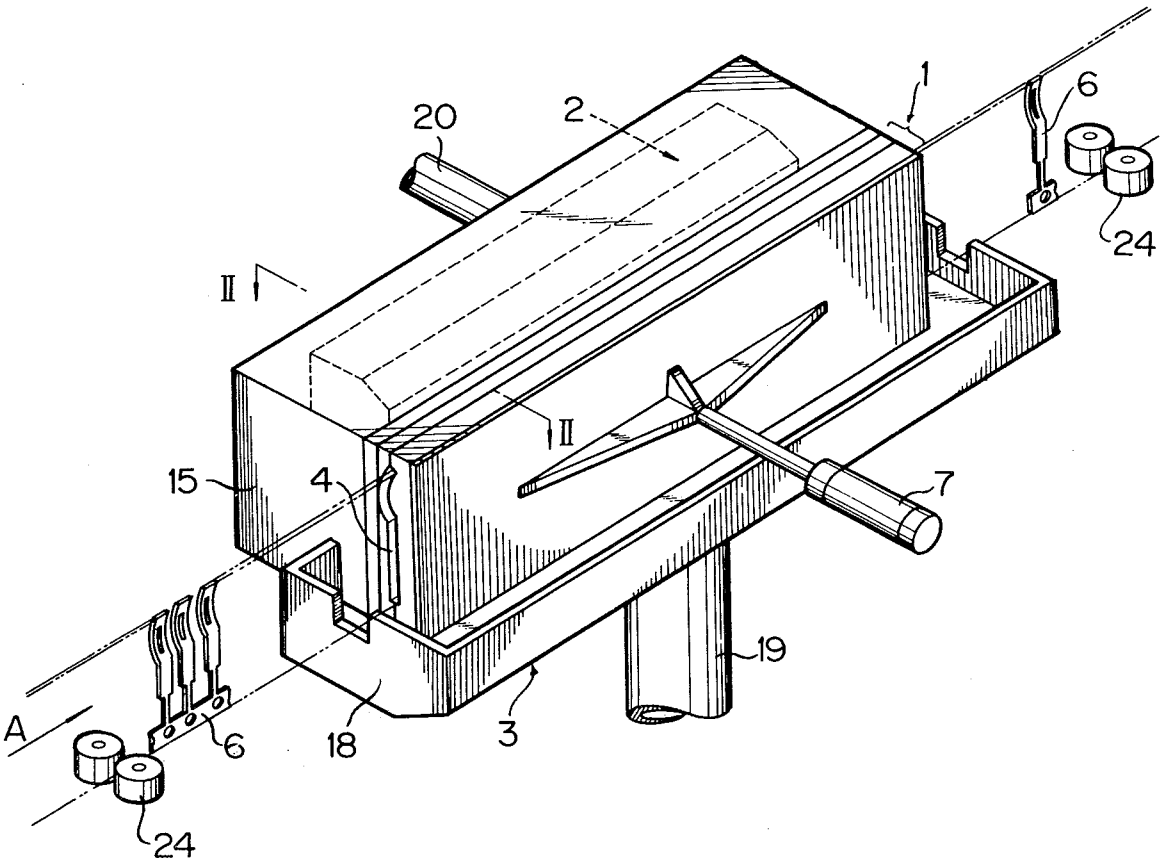
FIG. 1 is a general perspective view of a high-speed continuous plating apparatus illustrating with phantom lines the manner in which the objects to be plated are being fed.

The present invention will now be described in greater detail with reference to the accompanying drawings. (In the discussion to follow, the same reference numerals are employed for the identical and corresponding parts.) Describing first one apparatus for performing the novel method of applicant's invention, the high-speed continuous plating apparatus according to this invention principally comprises masking guide means 1, an anode and solution spray nozzle 2 and plating solution recovery means 3.

The masking guide means 1 includes a guide tunnel 4 and a plating solution spraying opening 5. The guide tunnel 4 is formed into a shape corresponding to the cross-sectional shape of the objects to be plated such as connectors in continuous form as shown in FIG. 5, and when the connectors 6 are fed through the guide tunnel 4 a small clearance is left between the outer surface of the connectors 6 and the inner wall of the guide tunnel 4. The guide tunnel 4 is formed to extend through the masking guide means 1 in the lengthwise direction thereof and the continuous connectors 6 are fed through the guide tunnel 4 in the direction of an arrow A. The solution spraying opening 5 is formed to communicate with the guide tunnel 4 in a direction intersecting the latter and its opening is selected to correspond to the area of the desired portion of the objects to be plated. As shown in FIG. 5, it is necessary to plate only one side of the selected portion of the connectors 6 having a width *l* and formed into arcuate shape. Thus, in FIGS. 1, 2 & 4, the solution spraying opening 5 has a vertical dimension corresponding to the width *l* of the selected portions and a part of the guide tunnel 4 is formed into arcuate shape corresponding to the arcuate shape of the selected portions. Of course, the connectors 6 thus plated must be cut off when they are to be put in use.

The masking guide means 1 is made from a material, e.g., Teflon (trademark) having such properties as corrosion resistance, wear resistance, electrical insulating properties and low friction coefficient, and although the entire masking guide means 1 may be made by one-piece molding, it may be advantageously made in two parts as shown in the drawings so as to facilitate the working of the guide tunnel 4 and the solution spraying opening 5 thereon. In this case, a split member 1*b* may be pressed against another split member 1*a* by a pressure cylinder 7 so as to tightly press the contacting portions of the two members against each other. Moreover, when introducing objects to be plated into the guide tunnel, the contacting portions of the two members may be separated to provide a small gap therebetween to facilitate the introduction of the objects. A spring may be employed in place of the pressure cylinder 7. If desired, split members 8*a* and 8*b* shown in FIG. 3 may be employed in place of the split members 1*a* and 1*b*. On the portion of the split member 8*b* corresponding to that side of a guide tunnel 10 opposite to the side on which a solution spraying nozzle 9 is formed, there is provided a hollow portion 11 which may be filled with the plating solution and an anode 12 is provided in the hollow portion 11. Numeral 13 designates a plating solution recovery passage. With masking guide means 8 shown in FIG. 3, it is possible to plate both sides of the objects to be plated as will be described later. The guide tunnel 10 of FIG. 3 has a shape which is different from that of the previously described guide tunnel 4. This means that guide tunnels having different shapes may be selectively employed to suit the cross-sectional shape of the objects to be plated. Thus, the split member 1*a* or 8*a* is detachably attached to the mounting surface of a plating box 15 by screws or other suitable means and the other split member 1*b* or 8*b* is detachably attached to a plate 14 connected to the pressure cylinder 7.

The solution spray nozzle 2 which is the anode is arranged in the plating box 15 in a position opposite to the solution spraying opening 5 or 9 of the masking guide means 1 or 8. In the drawings, the forward end portion 16 of the nozzle 2 is a metal portion constituting the anode.

The plating solution recovery means 3 includes a pipe 17 fitted to communicate with the opening (not shown) in the bottom of the plating box 15, a trough-type catch box 18 assembled to the plating box 15, a pipe 19 fitted to communicate with the bottom opening (not shown) of the box 18 and other component parts including a plating solution tank, a pump, etc., which are not shown, and the plating solution recovered through the pipes 17 and 19 is recirculated and fed back to the solution spray nozzle 2 through a pipe 20.

The operation of the plating apparatus constructed as described above will now be described along with the description of the novel high-speed plating method of this invention. After the gap or opening of the guide tunnel 4 has been slightly widened through the operation of the pressure cylinder 7, a pair of rollers 24 provided on each of the inlet and outlet sides of the plating box 15 and also serving as the cathode are rotated to introduce the connectors 6 or objects to be plated into the guide tunnel 4 and the feeding of the connectors 6 through the guide tunnel 4 is started after the split members l*a* and 1b. of the masking guide means 1 have been tightly pressed against each other by the pressure cylinder 7. Consequently, the connectors 6 are moved through the guide tunnel 4 in the direction of the arrow A and while the connectors 6 are being fed, the plating solution having a composition suitable for the desired high speed plating is sprayed from the anode and solution spray nozzle 2 against the solution spraying opening 5. As a result, those portions of the connectors 6 which are placed on the spray nozzle side (the front portions) are succcessively exposed and plated at the solution spraying opening 5 and a large portion of the excess plating solution is recovered from the plating box 15 through the pipe 17, while the excess plating solution introduced into the guide tunnel 4 flows through the small clearance between the inner surface of the guide tunnel 4 and the outer surface of the objects to be plated and through the lower ends of the guide tunnel 4 into the trough-type catch box 18 and the plating solution is recovered through the pipe 19. In this way, while the objects to be plated are being fed through the guide tunnel 4 of the masking guide means 1, only the desired portions of the objects are continuously plated at high speed.

Figure 2:
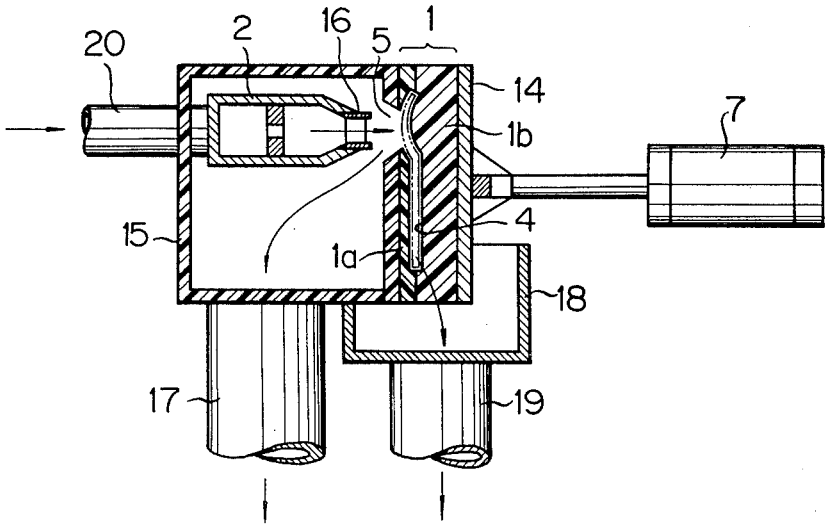
FIG. 2 is a sectional view taken along the line II — II of FIG. 1 showing in detail the masking guide means in the plating box.
Figure 3:
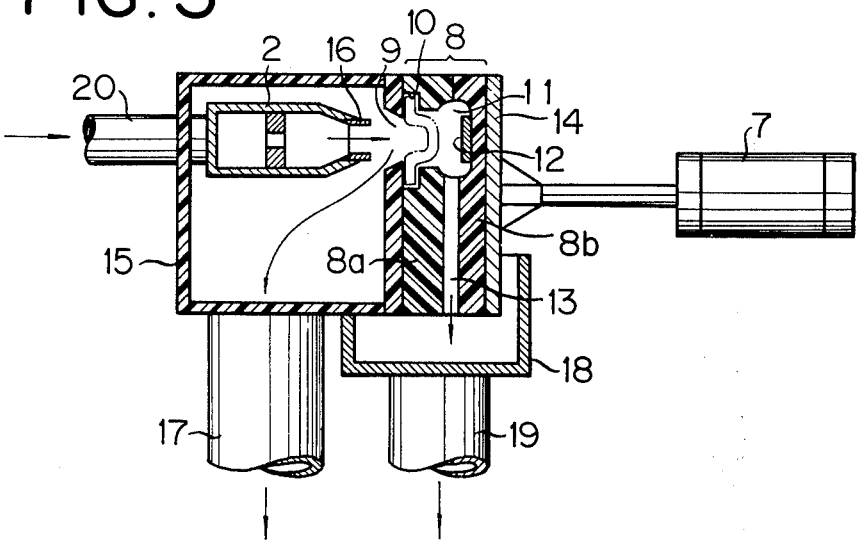
FIG. 3 illustrates a modified form of FIG. 2 wherein the masking means is modified to ensure more positive plating of both sides of the objects to be plated.

The apparatus shown in FIGS. 1, 2 and 3 and the plating method performed by this apparatus are chiefly designed to plate on side (the front side) of objects to be plated, although the back side of the objects are also plated, and therefore where it is desired to positively plate both sides of the objects, the apparatus shown in FIG. 3 may be advantageously employed. More specifically, while the plating process of this apparatus is the same with that of the previously described plating method up to the spraying of the plating solution from the anode and solution spray nozzle 2, the plating solution is introduced through a gap 25 between the objects (FIG. 5) into and fills the hollow portion 11 on the backside of the objects and the back side of the objects are successively plated in the similar manner as the front side of the objects by the action of the anode 12 in the hollow portion 11. The excess plating solution is introduced into the trough-type catch box 18 through the recovery passage 13 and it is then recovered through the pipe 19. Of course, a large part of the excess plating solution is recovered through the plating box 15 and the pipe 17.

Figure 4:
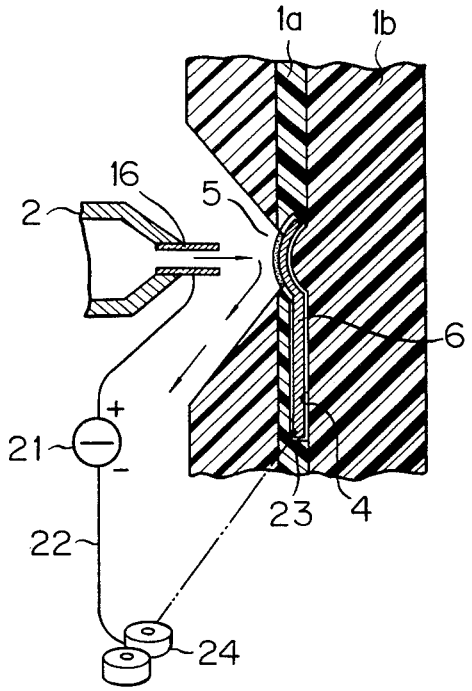
FIG. 4 is a partial enlarged view of FIG. 2 showing the manner in which the objects are plated.
Figure 5:
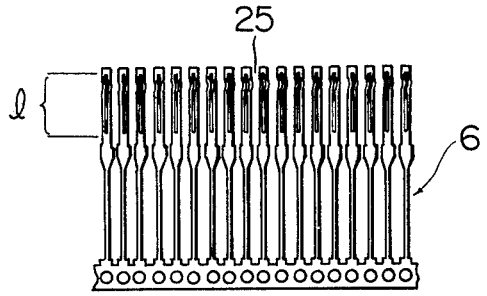
FIG. 5 is a perspective view of connectors in continuous form shown as an example of objects to be plated.

With the plating method of this invention, as shown in FIG. 4, the nozzle forward end portion 16 is used as the anode and the objects to be plated, e.g., connectors 6 are connected to a DC power source 21 through the cathode and guide rollers 24 connected to the DC power source 21 through a lead wire 22 thus constituting the cathode.

By employing a plating apparatus constructed as shown in FIGS. 1, 2 and 4, gold plating was applied on the desired portions or width $l$ of continuous connectors of the shape shown in FIG. 5 by the method of this invention with current density of 15 A/dm$^2$ and the resulting plating thickness of the connectors was measured with a non-destructive thickness measuring apparatus, obtaining the following actual measurements which were excellent:

Average plating thickness- Front side (anode side)=0.72 $\mu$; Back side =0.37 $\mu$ The plating time was 11 seconds and the feeding speed of the connectors was 0.05 m/sec. The length of the solution spraying opening was 0.55 m and the plating solution was sprayed from the nozzle at the rate of 3.5 $l$/sec.

It will thus be seen from the foregoing description that in accordance with the plating method and apparatus of this invention, in order to continuously plate at high speed any objects having a complicated shape, such as, irregular continuous objects or partially or intermittently connected objects such as connectors, masking guide means is made from a material having electrical insulating properties as well as corrosion resistance, wear resistance and low friction coefficient, the masking guide means is provided therein with a guide tunnel for feeding there- through objects to be plated, a solution spraying opening is provided which is communicated with the guide tunnel to plate only the desired portions of the objects and an anode and solution spray nozzle is placed in a position opposite to the solution spraying opening, whereby while such objects are being fed continuously through the guide tunnel, a plating solution which is suitable for plating the objects with high current density is sprayed from the solution spray nozzle against the solution spraying opening thereby accomplishing through the solution spraying opening the desired high-speed continuous plating on the desired one side of the objects easily and positively, while, if desired, accomplishing the plating of both sides of the objects positively, too. The remaining portions of the objects which need not be plated are shielded by the masking guide means and moreover these portions are remotely placed from the anode thus preventing any positive plating of these portions. The amount of excess plating solution sprayed from the nozzle and introduced into the small clearance in the guide tunnel during the feeding of the objects is such that the portions of the objects exposed to the clearance will be coated with a very thin plating on the whole, thus contributing toward economical use of the plating solution.

Thus, with the method and apparatus of this invention, there is no need to tightly mask any objects in complicated continuous form and moreover irrespective of the shape of objects to be plated, only the desired portions of objects can be continuously plated at high speed without requiring any complicated peripheral operations. Thus, the method and apparatus of this invention are efficient and have great economical features and advantages and moreover they are of great utility value since they have wide application including the selective plating of the contact portions of connectors as well as the selective plating of other objects requiring such plating.

What is claimed is:

1. A high-speed continuous plating method of the type employing an anode and solution spray nozzle to plate objects to be plated, wherein while a plurality of objects to be plated which are in complicated continuous form are being fed into and through an object feeding guide tunnel provided in a plating box and having a shape corresponding to the shape of said objects, a plating solution suitable for plating said objects with high current density is continuously sprayed against a solution spraying opening which communicates with said object feeding guide tunnel and has a predetermined dimension, said plating solution being sprayed from a solution spray nozzle disposed in a position opposite to said solution spraying opening whereby to continuously plate the selected side of said objects at high speed.

2. A high-speed continuous plating apparatus comprising, in combination with an elongated plating box:

masking guide means including an elongated guide tunnel for feeding therethrough objects to be plated, said guide tunnel being adapted to closely confine said objects as they move through said tunnel, means for feeding objects to be plated through said tunnel, said tunnel having an elongated solution spraying opening communicating with the interior of said plating box for exposing a limited area of said objects to be plated as they pass through said tunnel, an anode and solution spray nozzle disposed in said plating box opposite to said solution spraying opening, and solution recovering means for recovering a plating solution flowing out from said guide tunnel.

3. Apparatus according to claim 2, wherein said masking guide means further includes a hollow portion provided on one side of said guide tunnel opposite to that side thereof where said solution spraying opening is provided, said hollow portion being disposed to be filled with said plating solution; and wherein an anode is provided in said hollow portion.

4. Apparatus according to claim 2, wherein said masking guide means is detachably mounted on said plating box, whereby different masking guide means may be selectively employed to suit the cross-sectional shape of objects to be plated.

* * * * *